US006735400B2

(12) United States Patent
Mathea

(10) Patent No.: US 6,735,400 B2
(45) Date of Patent: May 11, 2004

(54) ELECTROPHOTOGRAPHIC OR IONOGRAPHIC PRINTER WITH VARIABLE PRINTING SPEED

(75) Inventor: Hans Mathea, Eggenstein-Leopoldshafen (DE)

(73) Assignee: CSAT Gesellschaft für Computer-Systeme und Automations-Technik mbH, Eggenstein-Leopoldshafen (DE)

( * ) Notice: Subject to any disclaimer, the term of this patent is extended or adjusted under 35 U.S.C. 154(b) by 0 days.

(21) Appl. No.: 10/373,889

(22) Filed: Feb. 25, 2003

(65) Prior Publication Data

US 2003/0142987 A1 Jul. 31, 2003

Related U.S. Application Data

(63) Continuation-in-part of application No. PCT/DE01/03159, filed on Aug. 24, 2001.

(30) Foreign Application Priority Data

Sep. 1, 2000 (DE) ..... 100 43 333

(51) Int. Cl.[7] ..... G03G 15/00; G03G 15/02; G03G 15/043; G03G 15/06

(52) U.S. Cl. ..... 399/48; 399/50; 399/51; 399/55; 399/66

(58) Field of Search ..... 399/48, 50, 51, 399/55, 46, 73, 66; 347/133

(56) References Cited

U.S. PATENT DOCUMENTS

| | | | | |
|---|---|---|---|---|
| 3,788,739 A | 1/1974 | Coriale | ..... | 399/48 |
| 5,659,841 A | 8/1997 | Umeda et al. | ..... | 399/55 |
| 5,832,333 A | 11/1998 | Umeda et al. | ..... | 399/48 |

FOREIGN PATENT DOCUMENTS

| | | | | |
|---|---|---|---|---|
| DE | 30 08 488 | 9/1980 | | |
| DE | 32 21 618 | 12/1982 | | |
| DE | 43 36 690 A1 | 5/1995 | | |
| JP | 2003107812 A * | 4/2003 | ..... | G03G/15/00 |

OTHER PUBLICATIONS

Patent Abstracts of Japan, Publ. No. 57086842, Makita Katsuhiko, Adjustment Device for Density Irregularity of Electrophotographic Copying Machine.

* cited by examiner

*Primary Examiner*—Arthur T. Grimley
*Assistant Examiner*—Ryan Gleitz
(74) *Attorney, Agent, or Firm*—Klaus J. Bach

(57) ABSTRACT

In a printer with an electrically chargeable image drum, such as a laser or a LED printer, for imprinting a medium by transferring toner to the medium, including, arranged around the image drum, a charging unit, a writing unit and a toner unit, the toner unit is disposed at a predetermined angular distance from the charging unit and a sensor is disposed at essentially the same angular distance from the charging unit to determine the charge of the image unit at the toner location for adjusting the voltage of at least one of the charging unit and the toner unit depending on the charge voltage of the image drum as determined by the sensor.

7 Claims, 1 Drawing Sheet

ELECTROPHOTOGRAPHIC OR IONOGRAPHIC PRINTER WITH VARIABLE PRINTING SPEED

This is a Continuation-In-Part application of international application PCT/DE01/03159 filed Aug. 24, 2001 and claiming the priority of German application 100 43 033.3 filed Sep. 1, 2000.

BACKGROUND OF THE INVENTION

The invention relates to an electrophotographic or ionographic printer with variable printing speed, including a chargeable image drum, particularly a laser or LED printer for imprinting a medium. A charging unit is provided for charging the image drum and also a toner unit for applying toner to the image drum. The toner unit is arranged in the direction of rotation of the image drum at a predetermined angular distance behind the charging unit. Further, a writing unit is provided by which a beam is moved across the image drum for changing the electric charge on the image drum and there is also a sensor for detecting the charge of the image drum.

Such printers are well known in the art. They achieve an optimal printed image by appropriately tuning the parameters of the printer to one another. In particular, the ratio of the surface charge of the image drum at the deposit location of the toner from the toner unit onto the image drum to the voltage (BIAS) of the toner unit is adjusted according to the given parameters. Furthermore, the voltage of the writing unit must be so selected that a sharp image without ghost images is obtained. The value adjustments are always also dependent on certain ambient conditions.

When the ambient conditions change, the value adjustments or settings are no longer optimal so that the image quality deteriorates. This is also true for a change in the printing speed. It is therefore difficult to obtain a perfect image with changing ambient conditions and changing printing speeds.

In order to obtain an optimal image all parameters must be re-adjusted whenever the ambient conditions or the printing speed change. It is therefore problematic to change the speed of the image drum and, consequently, the printing speed. Printers with variable printing speed therefore generally do not provide optimal images.

It is known to determine the charge of the image drum to determine, in this way, the influence of the ambient conditions and to compensate for this influence by an adjustment to the voltage of the charging unit. The sensor for determining the image drum charge is arranged between the toner unit and the charging unit.

DE 43 36 690 A1 discloses an arrangement for measuring electrical potential contrasts on surfaces, which have a charge image wherein, by means of a measuring probe, an improved determination of the surface potentials is to be achieved and targeted changes of the surface potential are to be effected. To this end, the surface area is used as measuring area and is provided with selected charge patterns and the measuring probe is cutting-edge shaped and extends parallel to an edge of the charge pattern and normal to an assumed direction of movement.

As typical application example for the edge shaped measuring probe an electrophotographic printer is mentioned which includes a charging unit and a developer drum. Although the publication mentions that the measuring probes may be part of the developer station or, respectively, may be represented by the developer drum the printed publication includes no indication as to the effects of such an arrangement. Rather, the publication suggests as practical application an electrophotographic arrangement without developer station. The publication includes no hints to any compensation for changed ambient conditions or changing printing speeds.

Furthermore, Patent Abstracts of Japan, Vol. 006 No. 168 (P-139), 2. September 1982 (Sep. 9, 1982) and JP 57 086842 A (RICOH Co. LTD), May 31, 1982 (May 31, 1982) disclose an electrophotographic printer arrangement wherein detectors are arranged at the edges of an image drum by which the voltage of a corona generated is sensed. The corona generator is moved by a motor in axial direction until the two electrodes measure the same voltage.

U.S. Pat. No. 5,659,841 discloses an electrophotographic printing device which includes a sensor for determining the surface potential of an image drum between a first developer unit and a second developer unit.

Also, U.S. Pat. No. 3,788,739 discloses an electrophotographic printing device wherein a sensor for determining the surface potential of an image drum is arranged adjacent a writing unit. The writing unit and, consequently, the sensor are arranged, in the direction of rotation of the image drum, ahead of a developing unit.

Although with the detection of the charge of the image drum also the influence of changing ambient conditions can at least partially compensated the achievable compensation is not fully satisfactory.

It is therefore the object of the present invention to provide a printer of the type referred to above, that is a printer with variable printing speed, which delivers a perfect image also with changing ambient conditions and different printing speeds.

SUMMARY OF THE INVENTION

In a printer with an electrically chargeable image drum, such as a laser or an LED printer, for imprinting a medium by transferring toner to the medium, including, arranged around the image drum, a charging unit, a writing unit and a toner unit, the toner unit is disposed at a predetermined angular distance from the charging unit and a sensor is disposed at essentially the same angular distance from the charging unit to determine the charge of the image unit at the toner location for adjusting the voltage of at least one of the charging unit and the toner unit depending on the charge voltage of the image drum as determined by the sensor.

However the charge of the image drum at the predetermined angular distance from the charge unit can be determined also if the sensor is arranged at a slightly different location by a compensation procedure taking into account a standard deviation or the influences of the ambient conditions. It has been found that it is of utmost importance for the quality of the printed image that all parameters are adapted to the surface voltage of the image drum exactly at the depositing location of the toner on the image drum. Since the sensor detects the charge of the image drum at a predetermined angular distance from the first charging unit, which is exactly at the location where the toner is deposited on the drum, all previous influences can be eliminated in an advantageous manner by a corresponding compensation. It is, for example, possible in this way to compensate for a reduced surface voltage at the image drum instantly by a reduction of the voltage of the toner unit. At the same time, the voltage of the charging unit can be increased. When the area of the image drum, which was charged by the increased voltage of the charging unit, reaches the toner depositing location, that is, the sensor, the voltage of the toner unit can again be increased, since the previously lowered surface voltage of the image drum was completely compensated for by the increase of the voltage of the first charging unit.

Particularly advantageous is an embodiment of the invention wherein the image drum has an edge area which can be charged by the charging unit but which is not exposed to the beam of the writing unit and to which no toner is applied by the toner unit, and the sensor is arranged so as to detect the electrical charge of the image drum in this edge area. With such an arrangement, the sensor can be easily arranged in a simple manner exactly at the same angular distance from the first charging unit as the toner unit.

If it is for example determined by means of the sensor that the surface voltage of the image drum decreased in the area of the toner unit, this influence can be compensated for by an increase of the voltage of the charging unit as it is provided for in a particular embodiment of the present invention. However, it is also possible, instead of increasing the voltage of the charging unit, or in addition thereto, to reduce the voltage of the toner unit as it is done in accordance with another embodiment of the present invention. If the voltage of the toner unit is reduced, it is expedient, also to adjust the voltage of the transfer unit by which the toner present on the image drum is transferred to the medium. It has been found to be particularly advantageous if, whenever the voltage of the toner unit is changed, also the voltage of the transfer unit is changed correspondingly.

It has furthermore been found to be expedient, also to change the voltage of a discharge unit, by which the charge of the image drum is erased, depending on the output signal of the sensor. For the case that the surface voltage of the image drum increases in the area of the toner unit, an increase of the voltage of the discharge unit has been found to be very advantageous.

It has furthermore been found that, upon an increase of the surface voltage of the image drum in the area of the toner unit, an increase of the voltage of the writing unit positively affects the image quality.

Further features of the invention will become apparent from the following description of a particular embodiment of the invention on the basis of the accompanying drawings.

DESCRIPTION OF PREFERRED EMBODIMENTS

Figure 1:
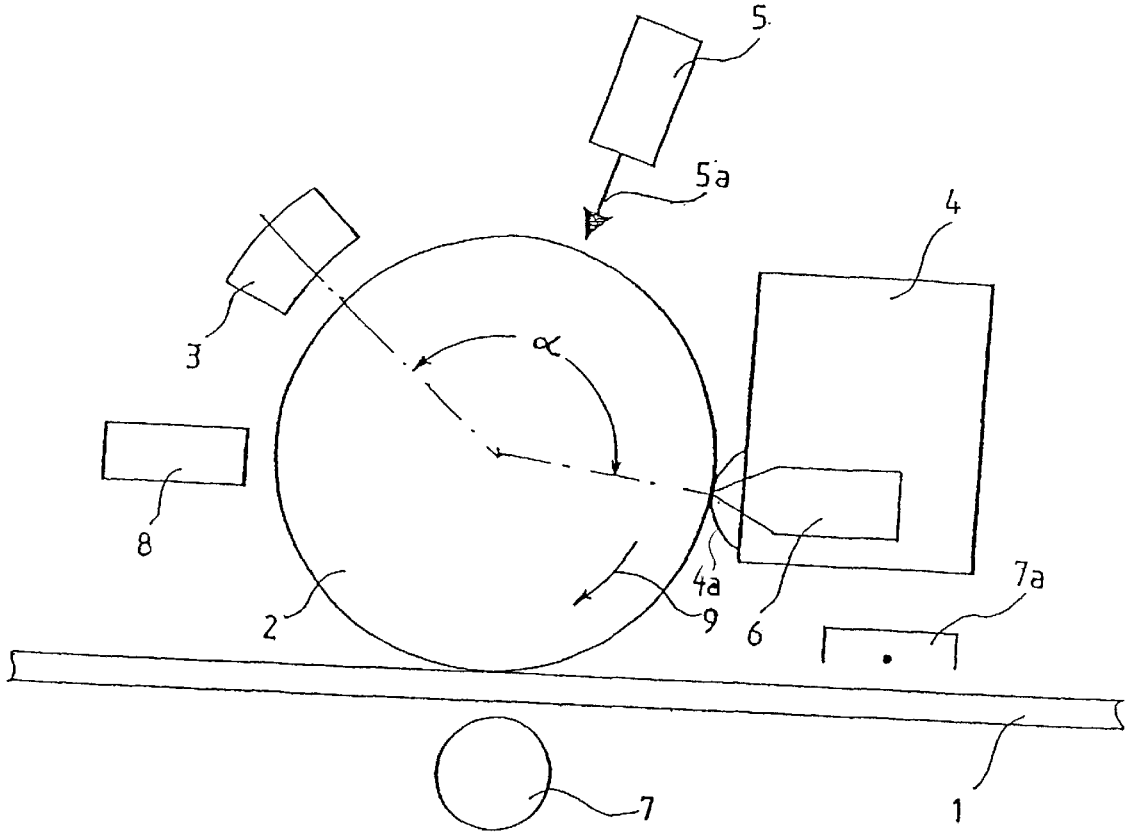
FIG. 1 is a schematic side view of the printer according to the invention.

As shown in FIG. 1, a printer for imprinting a medium 1 includes an image drum 2, by way of which toner is transferred to the medium 1. The image drum 2 is electrically charged by a charging unit 3. After the charging unit 3, in the direction of rotation of the image drum 2 which is indicated by an arrow 9, a laser writing unit 5 is arranged. A laser beam 5*a* provided by the laser unit 5 is moved across the image drum 2 in accordance with the image to be printed. Where the laser beam impinges on the surface of image drum, the image drum is discharged.

At a predetermined angular distance α in the direction of rotation 9 of the image of drum 2 after the charging unit 3, a toner unit 4 as arranged by which toner is deposited on the image drum 2. In the places where the surface of the image drum is still electrically charged the toner adheres to the surface of the image drum 2.

In the direction of rotation 9 of the image drum 2 behind the toner unit 4, a transfer unit 7 is arranged by means of which the toner adhering to the surface of the image drum 2 is transferred to the medium to be imprinted. For the imprinting of metal foils, a second transfer unit 7*a* is arranged at the side of the foil which is imprinted.

For discharging the surface of the image drum 2 an erasing unit 8 is arranged in the direction of rotation 9 after the transfer unit 7.

At the same angular distance a by which the toner unit 4 is arranged after the charging unit 3, a sensor 6 is arranged adjacent the image drum surface by way of which the electrical charge on the surface of the image drum 2 can be measured. It is noted however that the sensor 6 does not need to be arranged at exactly the same location at which the toner is applied. Design conditions may not allow the most desirable location of the sensor. A slightly different location is acceptable. Different measurement values obtained thereby can be compensated for by taking into account a standard deviation and/or the particular environmental conditions.

Figure 2:
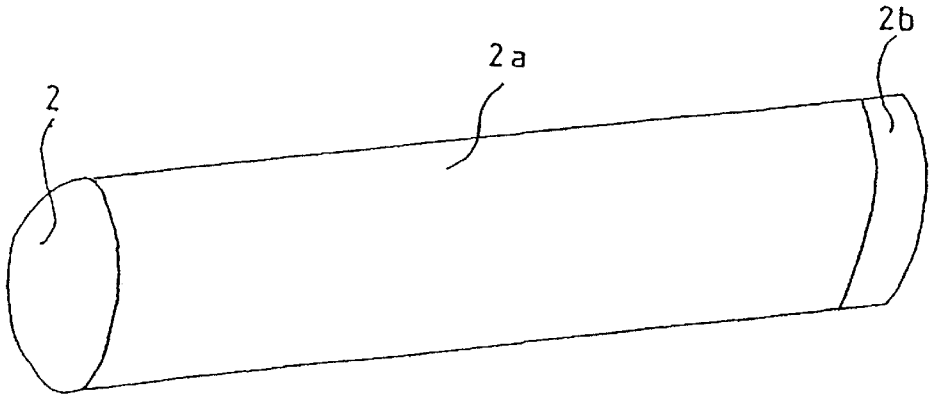
FIG. 2 is a schematic representation of an image drum according to the invention.

As shown in FIG. 2, the image drum 2 includes an area 2*a*, to which toner can be applied and which has the same width as the toner transfer element of the toner unit 4. In addition, the image drum 2 includes a sensor area 2*a*, which is not covered by the toner transfer element 4*a* of the toner unit 4. The sensor area 2*b* is covered however by the charge unit 3 and by the erasing unit 8 but is not exposed to the laser beam 5*a* of the laser unit 5.

The sensor 6 is so arranged that it is disposed opposite the sensor area 2*b* so that it can sense the electrical charge of the surface area of the image drum 2 or, respectively, the surface voltage of the image drum 2 in the area 2*b*. In this way, no design changes of the toner unit 4 are required.

What is claimed is:

1. A printer with an electrically chargeable image drum (2) such as an electrophotographic or ionographic printer, particularly a laser or LED printer, for imprinting a medium (1) wherein the image drum (2) serves to transfer toner to a medium, said printer further including a charging unit (3) for charging the image drum (2), a toner unit (4) by which toner is transferred to the image drum (2) and which is disposed at a predetermined angular distance α, in the direction of rotation (9) of the image drum (2), past the charging unit (3), a writing unit (5) generating a beam (5*a*) directed onto a surface of the image drum (2) for changing an electrical charge of the surface of the image drum (2) in accordance with an image to be imprinted onto the medium (1), and a sensor (6) arranged adjacent the image drum (2) also essentially at the predetermined angular distance α from the charging unit (3) for determining the charge of the image drum at the predetermined angular distance from the charging unit (3).

2. A printer according to claim 1, wherein said image drum (2) includes an edge area (2*b*) which is not exposed to the beam of the writing unit (5) and to which no toner is applied by the toner unit, and the sensor (6) is arranged adjacent the edge area (2*b*) whose electrical charge it determines as representative of the charge of the image drum (2) at the distance α from the charging unit (3).

3. A printer according to claim 1, wherein a charge voltage of the toner unit (4) is adjustable depending on the charge voltage sensed by the sensor (6).

4. A printer according to claim 1, wherein a voltage of the charge unit (3) is adjustable depending on the charge voltage of the image drum (2) determined by the sensor (6).

5. A printer according to claim 1, wherein said printer includes a transfer unit (7, 7*a*) for transferring an image from the image drum (2) to the medium (1) to be imprinted, and the transfer unit has a voltage, which is adjustable depending on the charge voltage of the image drum (2) as determined by the sensor (6).

6. A printer according to claim 1, wherein an eraser unit (8) is arranged adjacent the image drum for discharging the image drum (2) and the eraser unit (8) has a voltage, which is adjustable depending on the charge voltage of the image drum (2) as determined by the sensor (6).

7. A printer according to claim 1, wherein the writing unit has a voltage, which is adjustable depending on the charge voltage of the image drum (2) as determined by the sensor (6).

* * * * *